US007827954B2

(12) United States Patent
Nagasawa et al.

(10) Patent No.: US 7,827,954 B2
(45) Date of Patent: Nov. 9, 2010

(54) PLASMA-JET SPARK PLUG CONTROL METHOD AND DEVICE

(75) Inventors: Satoshi Nagasawa, Nagoya (JP); Katsunori Hagiwara, Mie (JP); Wataru Matsutani, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 1012 days.

(21) Appl. No.: 11/603,158

(22) Filed: Nov. 22, 2006

(65) Prior Publication Data

US 2007/0114901 A1 May 24, 2007

(30) Foreign Application Priority Data

Nov. 22, 2005 (JP) ..... 2005-337558
Sep. 15, 2006 (JP) ..... 2006-250583

(51) Int. Cl.
*H01T 13/54* (2006.01)
*H01T 13/20* (2006.01)

(52) U.S. Cl. ..... 123/143 B; 313/141; 123/169 EL

(58) Field of Classification Search ..... 123/143 B, 123/179.5, 605, 608, 609, 618, 620, 640, 123/169 R, 169 EL; 701/101–103; 313/118, 313/132, 141, 143
See application file for complete search history.

(56) References Cited

U.S. PATENT DOCUMENTS 4,369,756 A * 1/1983 Ezoe ..... 123/620
4,441,479 A * 4/1984 Endo et al. ..... 123/143 B
5,555,862 A * 9/1996 Tozzi ..... 123/143 B
5,619,959 A * 4/1997 Tozzi ..... 123/143 B
6,244,247 B1 6/2001 Matsubara et al.
6,609,507 B2 * 8/2003 Wilkinson ..... 123/620
7,305,954 B2 * 12/2007 Hagiwara et al. ..... 123/143 B
7,328,677 B2 * 2/2008 Hagiwara et al. ..... 123/143 B
2007/0114898 A1 * 5/2007 Nagasawa et al. ..... 313/141
2008/0238283 A1 * 10/2008 Nakamura et al. ..... 313/143

FOREIGN PATENT DOCUMENTS

JP 55-51830 U 4/1980
JP 57-2470 A 1/1982
JP 63-123771 U 8/1988
JP 2000-161192 A 6/2000
WO 97/43544 A1 11/1997

* cited by examiner

*Primary Examiner*—Willis R Wolfe, Jr.
(74) *Attorney, Agent, or Firm*—Sughrue Mion, PLLC

(57) ABSTRACT

There is provided a method for controlling a plasma-jet spark plug in a four-stroke internal combustion engine, including the steps of: causing the spark plug to generate a primary discharge during either a compression stroke or an expansion stroke of the engine in such a manner as to produce a plasma by the primary discharge; and causing the spark plug to generate a secondary discharge during a time after the primary discharge and before the completion of a subsequent intake stroke of the engine.

14 Claims, 5 Drawing Sheets

PLASMA-JET SPARK PLUG CONTROL METHOD AND DEVICE

BACKGROUND OF THE INVENTION

The present invention relates to a method and device for controlling a plasma-jet spark plug that produces a plasma by a spark discharge to ignite an air-fuel mixture in an internal combustion engine.

A spark plug is widely used in an automotive internal combustion engine to ignite an air-fuel mixture by spark discharge. In response to the recent demand for high engine output and fuel efficiency, it is desired that the spark plug increase in ignitability to achieve quick combustion and proper lean mixture ignition.

Japanese Laid-Open Patent Publication No. 57-2470 discloses, as one example of high-ignitability spark plug, a plasma-jet spark plug that has an electrical insulator made of e.g. ceramic and a pair of center and ground electrodes defining therebetween a discharge gap surrounded with the electrical insulator to produce a plasma by a spark discharge in the discharge gap through the application of a high voltage between the center and ground electrodes. The plasma is ejected to an air-fuel mixture through an opening of the discharge gap so as to induce ignition of the air-fuel mixture at a distance away from the ground electrode. The plasma-jet spark plug is thus able to limit the quenching effect of the ground electrode for improvement in ignitability.

SUMMARY OF THE INVENTION

During vehicle starting and engine idling etc. where the air-fuel mixture is fuel rich, there is a possibility that the discharge gap of the plasma-jet spark plug becomes fouled due to incomplete combustion of the air-fuel mixture. In such a case, the insulation resistance of the discharge gap decreases to cause an ignition failure in the spark plug by a short circuit between the center and ground electrodes. This results in clogging of the discharge gap opening without being able to eliminate the plug fouling.

It is therefore an object of the present invention to provide a method and device for controlling a plasma-jet spark plug in such a manner as to allow self-cleaning of the spark plug.

According to a first aspect of the present invention, there is provided a method for controlling a plasma-jet spark plug in a four-cycle internal combustion engine, the spark plug having a pair of electrodes defining therebetween a discharge gap and an electric insulator surrounding at least part of the discharge gap to form a cavity in the discharge gap, the method comprising: causing the spark plug to generate a primary discharge in the discharge gap during either a compression stroke or an expansion stroke of the engine in such a manner as to produce a plasma in the cavity; and causing the spark plug to generate a secondary discharge in the discharge gap during a time after the primary discharge and before the completion of a subsequent intake stroke of the engine.

According to a second aspect of the present invention, there is provided an device for controlling a plasma-jet spark plug in a four-cycle internal combustion engine, the spark plug having a pair of electrodes defining therebetween a discharge gap and an electric insulator surrounding at least part of the discharge gap to form a cavity in the discharge gap, the device being configured to: cause the spark plug to generate a primary discharge in the discharge gap during either a compression stroke or an expansion stroke of the engine in such a manner as to produce a plasma in the cavity; and cause the spark plug to generate a secondary discharge in the discharge gap during a time after the primary discharge and before the completion of a subsequent intake stroke of the engine.

The other objects and features of the present invention will also become understood from the following description.

DESCRIPTION OF THE EMBODIMENTS

Figure 1:
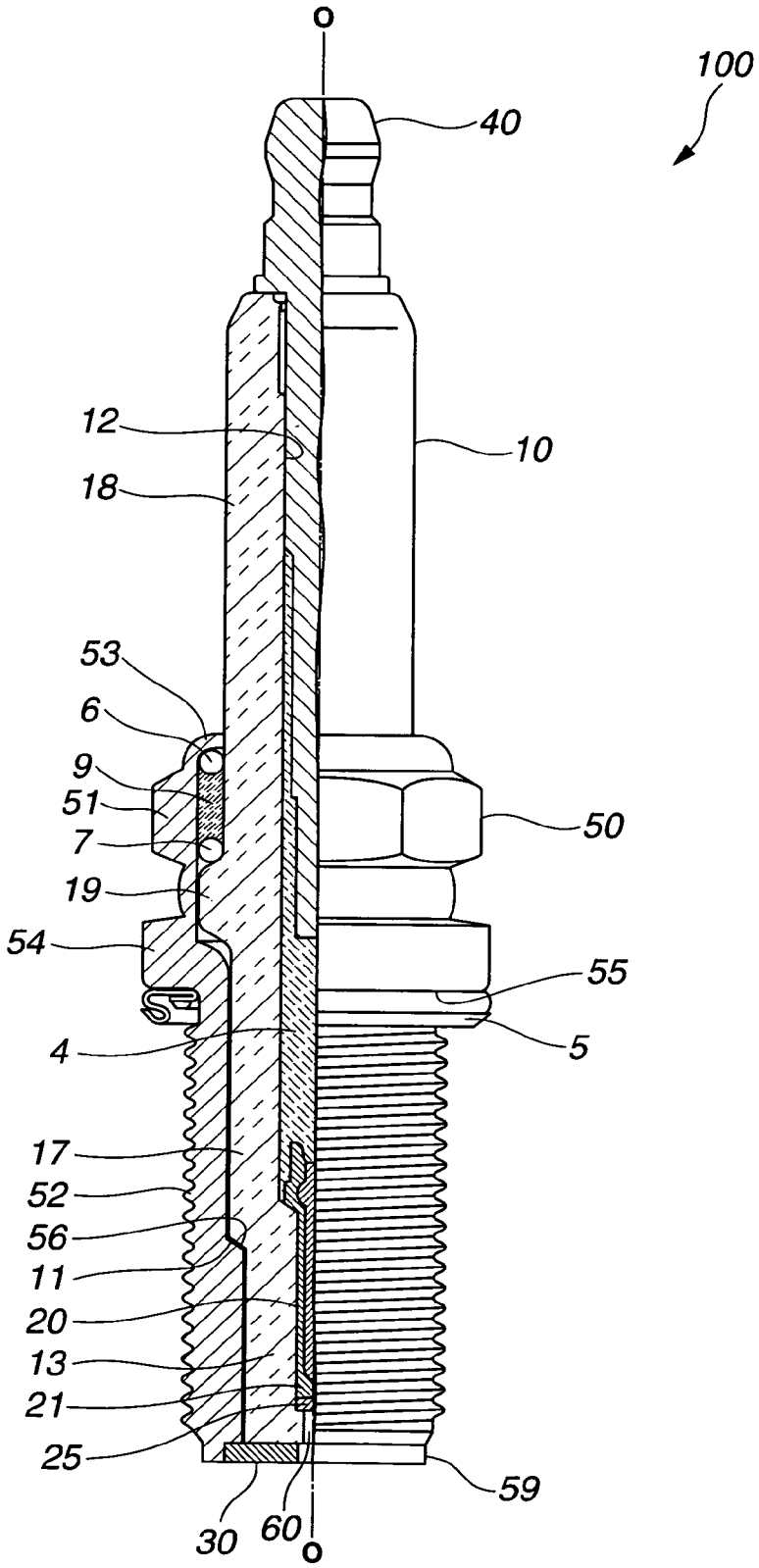
FIG. 1 is a half sectional view of a plasma-jet spark plug to which the present invention is applicable.

The present invention will be described below in detail. In the following description, like parts and portions are designated by like reference numerals to omit repeated explanations thereof.

A first embodiment of the present invention will be now explained below with reference to FIGS. 1 to 4.

There is provided according to the first embodiment an ignition system for a four-cycle internal combustion engine including a plasma-jet spark plug 100 and an ignition control device 200. Hereinafter, the term "front" is used to indicate a spark discharge side (bottom side in FIG. 1) with respect to the axial direction ○ of the spark plug 100 and the term "rear" is used to indicate a side (top side in FIG. 1) opposite to the front side.

Figure 2:
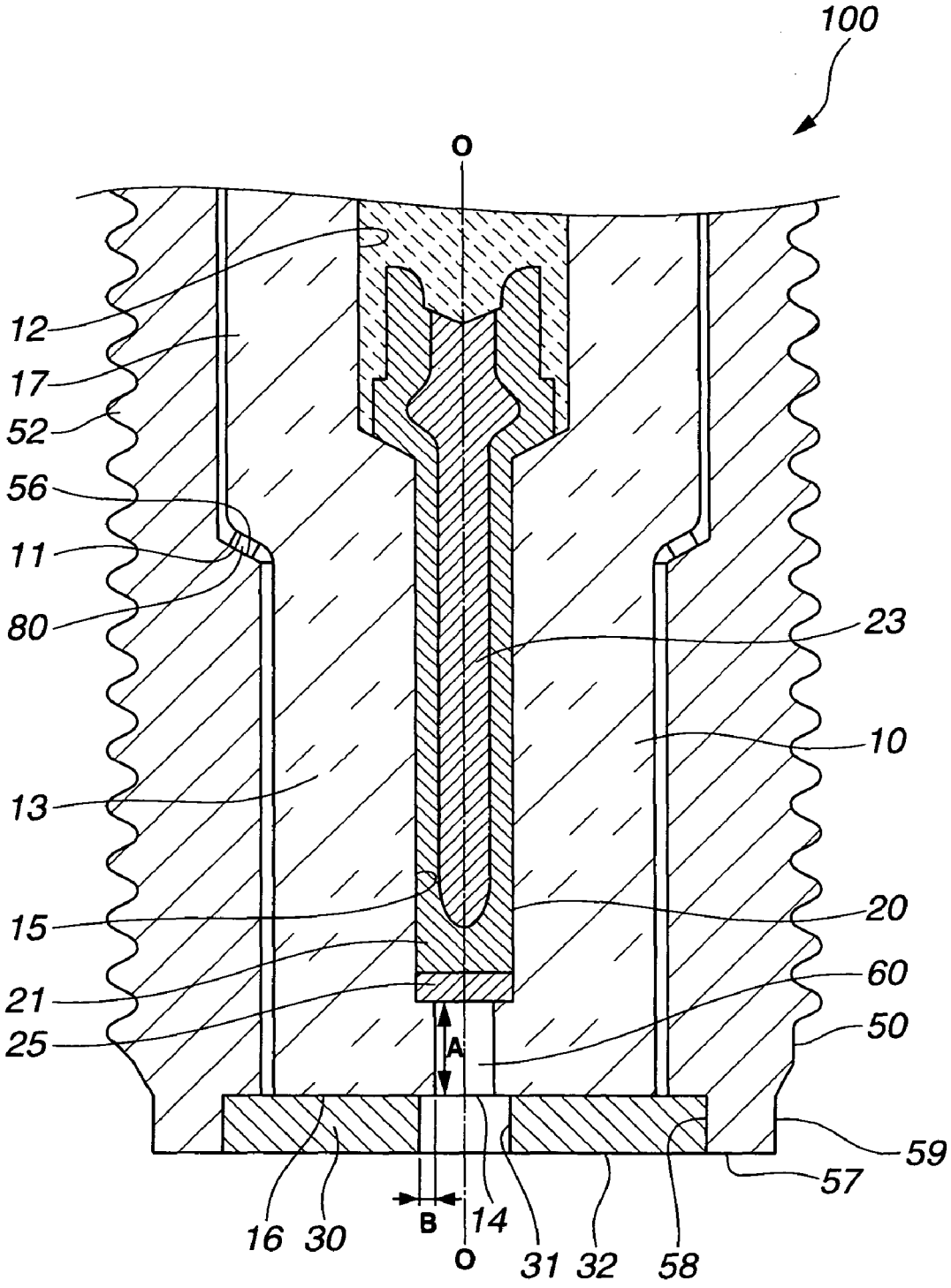
FIG. 2 is an enlarged sectional view of a front side of the plasma-jet spark plug of FIG. 1.

Referring to FIGS. 1 and 2, the spark plug 100 has a ceramic insulator 10 (as an electrical insulator), a metal shell 50 retaining therein the ceramic insulator 10, a center electrode 20 held in a front side of the ceramic insulator 10 along the axial direction ○ of the spark plug 100, a ground electrode 30 joined to a front end 59 of the metal shell 50 to define a discharge gap between the center electrode 20 and the ground electrode 30 and a metal terminal 40 held in a rear side of the ceramic insulator 10.

The ceramic insulator 10 is generally formed into a cylindrical shape with an axial through hole 12 and made of e.g. sintered alumina. As shown in FIG. 1, the ceramic insulator 10 includes a flange portion 19 protruding radially outwardly at around an axially middle position of the insulator 10, a rear portion 18 located on a rear side of the flange portion 19 and having a smaller outer diameter than that of the flange portion 19, a front portion 17 located on a front side of the flange portion 19 and having a smaller outer diameter than that of the rear portion 18 and a leg portion 13 located on a front side of the front portion 17 and having a smaller outer diameter than that of the front portion 17 so as to form an outer stepped surface 11 between the leg portion 13 and the front portion 17.

As shown in FIG. 2, the axial through hole 12 of the ceramic insulator 10 is composed of three sections: a reduced diameter section 15 axially corresponding in position to the leg portion 13; a front section extending on a front side of the reduced diameter section 15 to an opening 14 of the insulator hole 12; and a rear section extending on a rear side of the reduced diameter section 15. There is a cavity 60 defined by an inner circumferential surface of the front section of the insulator hole 12 and a front end face of the center electrode 20. In the first embodiment, the depth (axial length) of the cavity 60 is made larger than the diameter of the cavity 60. Further, the front and rear sections of the insulator hole 12 have small and larger diameters than that of the reduced diameter section 15, respectively, so as to form a front inner stepped surface between the front section and the reduced diameter section 15 and a rear inner stepped surface between the rear section and the reduced diameter section 15.

The center electrode 20 includes a column-shaped electrode body 21 made of e.g. nickel alloy material available under the trade name of Inconel 600 or 601, a metal core 23 made of e.g. highly thermal conductive copper material and embedded in the electrode body 21 and a disc-shaped electrode tip 25 made of precious metal and welded to a front end face of the electrode body 21 as shown in FIG. 2. The center electrode 20 is fitted in the reduced diameter section 15 of the insulator hole 12 with the electrode tip 25 exposed to the discharge cavity 60. A rear end of the center electrode 20 is flanged (larger in diameter) and seated on the rear inner stepped surface of the insulator hole 12 for proper positioning of the center electrode 20 in the ceramic insulator 10.

The metal terminal 40 is fitted in the rear section of the insulator hole 12 and is electrically connected at a front end thereof to the rear end of the center electrode 20 via a conductive seal material 4 and at a rear end thereof to a high-voltage cable via a plug cap for high voltage supply from the ignition control device 200 to the spark plug 100.

The conductive seal material 4 is filled between the rear end of the center electrode 20 and the front end of the metal terminal 40 within the rear section of the insulator hole 12 in such a manner as to not only provide electrical conduction between the center electrode 20 and the metal terminal 40 but fix the center electrode 20 and the metal terminal 40 in position within the insulator hole 12.

The ground electrode 30 is generally formed into a disc shape with a center through hole 31 and made of metal material having high resistance to spark wear e.g. nickel alloy available under the trade name of Inconel 600 or 601. As shown in FIG. 2, the ground electrode 30 is integrally fixed in the front end 59 of the metal shell 50 by laser welding an outer circumferential surface of the ground electrode 30 to an inner surface 58 of the front end 59 of the metal shell 50, with a rear face of the ground electrode 30 kept in contact with a front end face 16 of the ceramic insulator 10 and a front face 32 of the ground electrode 30 aligned to a front end face 57 of the metal shell 50. Herein, the ground electrode 30 establishes a ground for the spark plug 100 through the metal shell 50.

The metal shell 50 is generally made of iron material and formed into a cylindrical shape to surround therewith the ceramic insulator 10. As shown in FIGS. 1 and 2, the metal shell 50 includes a tool engagement portion 51 engaged with a tool such as plug wrench to mount the spark plug 100 on a cylinder block of the internal combustion engine, a threaded portion 52 formed with an inner stepped surface 56 on a front side of the tool engagement portion 51 and screwed into the engine cylinder block, a flange portion 54 formed between the tool engagement portion 51 and the threaded portion 52 and seated on the engine cylinder block and a rear end portion 53 formed on a rear side of the tool engagement portion 51 and crimped onto the rear portion 18 of the ceramic insulator 10 via a powdery talc material 9 and annular rings 6 and 7. There is a gasket 5 disposed between a surface of the engine cylinder block and a front surface of the flange portion 54.

The annular rings 6 and 7 are arranged between the tool engagement and rear end portions 51 and 53 of the metal shell 50 and the rear portion 18 of the ceramic insulator 10, and the powdery talc material 9 is filled between these annular rings 6 and 7. By crimping the rear end portion 53 of the metal shell 50 onto the ceramic insulator 10 via the annular rings 6 and 7 and talc material 9, the ceramic insulator 10 is placed under pressure and urged frontward within the metal shell 50 so as to mate the outer stepped surface 11 of the ceramic insulator 10 with the inner stepped surface 56 of the metal shell 50 via an annular packing 80 as shown in FIG. 2. The ceramic insulator 10 and the metal shell 50 is thus made integral with each other, with the gas seal between the ceramic insulator 10 and the metal shell 50 being ensured by the packing 80 for prevention of combustion gas leakage.

In the above-structured plasma-jet spark plug 100, a spark occurs with an electrical breakdown of gas (including air-fuel mixture) in the discharge gap when a high voltage is placed between the center electrode 20 and the ground electrode 30. The electrical breakdown allows a passage of electricity even through the application of a relatively small voltage. The gas in the discharge cavity 60 becomes ionized into a plasma phase by further voltage supply during the electrical breakdown. The thus-produced plasma is ejected through the insulator opening 14 and the electrode hole 31 to induce ignition and combustion of the air-fuel mixture in a combustion chamber of the engine.

In the first embodiment, the center hole 31 of the ground electrode 30 is made larger in diameter than the opening 14 of the axial through hole 12 of the ceramic insulator 10 so that the spark discharge occurs in the form of surface discharge (creepage) that causes the passage of electricity along a surface of the ceramic insulator 10. For this reason, the discharge gap can be divided into two discharge gap sections: an inner discharge gap section extending along the inner circumferential surface of the cavity 60 as indicated by an arrow A and an outer discharge gap section extending along the front end face of the ceramic insulator 10 outside of the cavity 60 as indicated by an arrow B as shown in FIG. 2.

The ignition control device 200 is connected to an electric control unit (ECU) of the engine to perform ignition timing control on the spark plug 100 in response to signals from the ECU. In the first embodiment, when the ECU periodically determines a regular (normal) ignition timing of the engine based on the ignition advance information from an engine crank angle sensor and outputs an ignition signal to the control device 200, the ignition control device 200 controls the application of high voltages to the spark plug 100 based on the ignition signal. The regular ignition timing is herein set to a time point during either a compression stroke or expansion stroke of the engine.

In the event of incomplete combustion of the air-fuel mixture ignited during the engine compression stroke or expansion stroke, the interior of the discharge gap of the spark plug 100 (notably, the inner circumferential surface of the cavity 60 and the front end face of the electrode tip 25) becomes fouled by carbon etc. Accordingly, the ignition control device 200 is configured to cause the spark plug 100 to generate a primary discharge at the regular ignition timing so as to induce ignition and combustion of the air-fuel mixture in the engine combustion chamber, and then, cause the spark plug 100 to generate a secondary discharge after the primary discharge so as to burn away carbon and any other fouling substance adhered to the interior of the discharge gap.

As mentioned above, the primary discharge is accompanied by two discharge phenomena: a trigger discharge phenomenon in which a spark occurs with an electrical breakdown of gas in the discharge gap when a high voltage is placed between the plug electrodes 20 and 30; and a transient plasma discharge phenomenon in which a plasma is produced in the discharge cavity 60 by further voltage supply during the electrical breakdown. The secondary discharge is, by contrast, not necessarily accompanied by the transient plasma discharge phenomenon (i.e. the plasma is not necessarily produced in the secondary discharge). As long as the fouling of the spark plug 100 gets burned away by the secondary discharge, the secondary discharge may be accompanied only by the trigger discharge phenomenon so as to decrease the energy of the discharge and secure higher durability of the electrodes 20 and 30.

Figure 3:
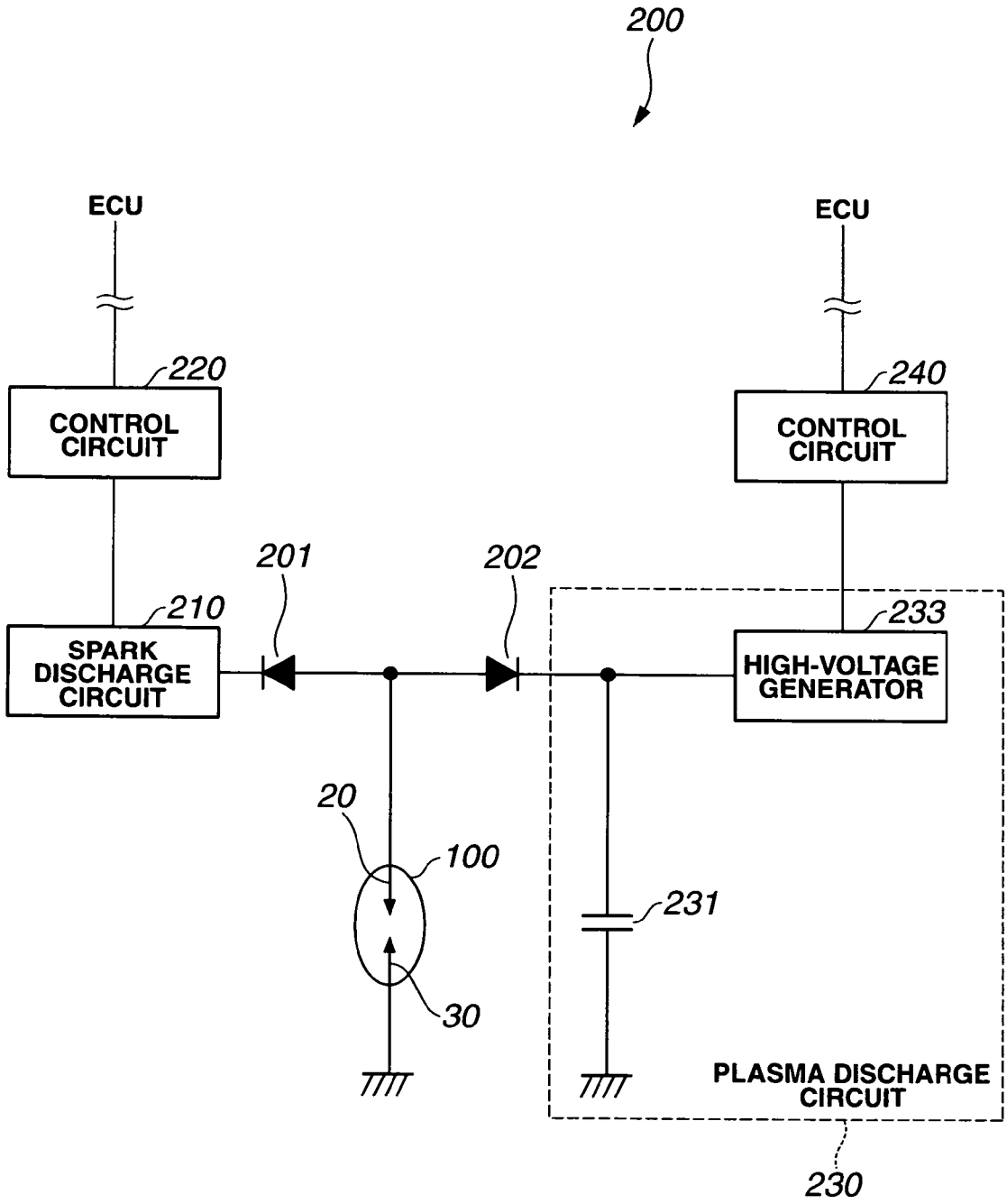
FIG. 3 is a circuit diagram of an ignition control device according to first or second embodiments of the present invention.

Referring to FIG. 3, the ignition control device 200 has a spark discharge circuit 210, a control circuit 220, a plasma discharge circuit 230, a control circuit 240 and backflow prevention diodes 201 and 202 in the first embodiment.

The spark discharge circuit 210 is provided in the form of a capacitor discharge ignition (CDI) circuit and electrically connected to the control circuit 220 and to the center electrode 20 of the spark plug 100 via the diode 201. Under the control of the control circuit 220, the spark discharge circuit 210 becomes operated to place a high voltage (e.g. of −20 kV) between the center and ground electrodes 20 and 30 of the spark plug 100 so as to cause a trigger discharge phenomenon in each of the primary and secondary discharges. In the first embodiment, the sign of potential of the spark discharge circuit 210 and the direction of the diode 201 are set in such a manner as to allow a flow of electric current from the ground electrode 30 to the center electrode 20 during the trigger discharge phenomenon.

The plasma discharge circuit 230 is electrically connected to the control circuit 240 and to the center electrode 20 of the spark plug 100 via the diode 202. Under the control of the control circuit 240, the plasma discharge circuit 230 becomes operated to supply high energy to the discharge gap so as to cause a transient plasma discharge phenomenon in each of the primary and secondary discharges. In the first embodiment, the plasma discharge circuit 230 is provided with a capacitor 231 and a high-voltage generator 233 as shown in FIG. 3. The capacitor 231 is used to store an electric charge as discharge activation energy and connected at one end thereof to a ground and at the other end thereof to the center electrode 20 via the diode 202. The high-voltage generator 233 is connected to the other end of the capacitor 231 to generate a high negative-polarity voltage (e.g. of −500 V) for charging the capacitor 231. The high-voltage generator 233 is also connected to the control circuit 240 so as to regulate the output voltage of the high-voltage generator 233 in response to the signal from the control circuit 240. Further, the sign of potential of the high-voltage generator 233 and the direction of the diode 202 are set in such a manner as to allow a flow of electric current from the ground electrode 30 to the center electrode 20 during the transient plasma discharge phenomenon.

The control circuits 220 and 240 control the operations of the spark and plasma discharge circuits 210 and 230 upon receipt of the ignition signal from the ECU. It is noted that, in the first embodiment, the regular ignition timing is set to a time point during the engine compression stroke.

Figure 4:
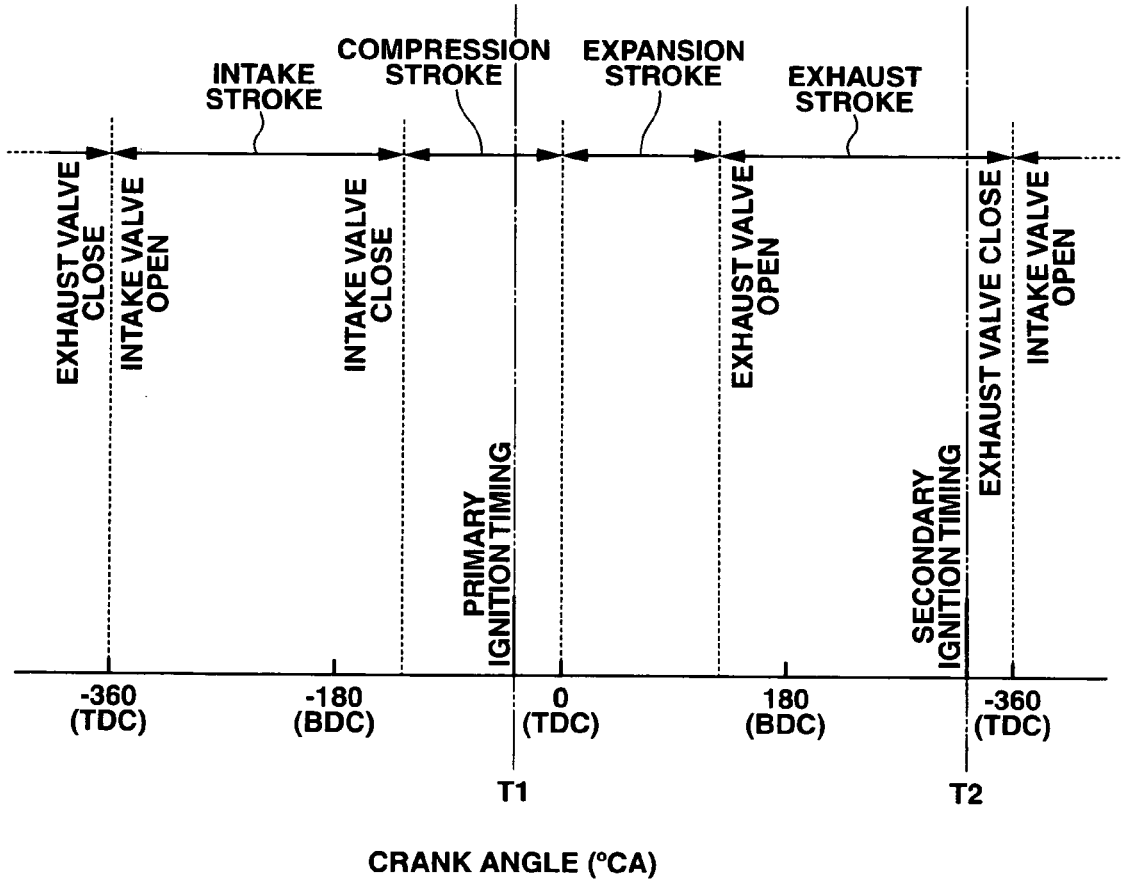
FIG. 4 is a time chart of ignition control operation of the ignition control device according to the first embodiment of the present invention.

As shown in FIG. 4, the control circuits 220 and 240 determine the timing of receipt of the periodical ignition signal from the ECU as a primary ignition timing T1 and determines any appropriate time point after the primary discharge and before the completion of a subsequent intake stroke of the engine as a secondary ignition timing T2. In the first embodiment, the secondary ignition timing T2 is set, on the assumption that the midpoint of the interval that the control circuits 220 and 240 receive the ignition signal from the ECU is in an exhaust stroke of the engine, to such a time point during the engine exhaust stroke.

At the primary ignition timing T1, the control circuit 220 enables the spark discharge circuit 210 to apply a high voltage to the spark plug 100 and cause a trigger discharge phenomenon. On the other hand, the control circuit 240 enables the plasma discharge circuit 230 to supply a given amount of energy E1 from the capacitor 231 to the spark plug 100 and cause a plasma discharge phenomenon. In such a primary discharge, the plasma is produced in the discharge cavity 60 and ejected into the combustion chamber through the insulator opening 14 and the electrode hole 31 to ignite the air-fuel mixture. The air-fuel mixture is then burned with flame propagation.

Before the primary ignition timing T1, the plasma discharge circuit 230 has a closed circuit configuration formed with the capacitor 231 and the high-voltage generator 233 since the electrical breakdown is not yet caused in the discharge gap and the backflow of electric current is prevented by the diode 202. The capacitor 231 is thus charged by the high-voltage generator 233 so that the energy E1 (hereinafter occasionally referred to as "primary discharge activation energy") is stored in the capacitor 231.

At the secondary ignition timing T2, the control circuit 220 enables the spark discharge circuit 210 to apply a high voltage to the spark plug 100 and cause a trigger discharge phenomenon. The control circuit 240 enables the plasma discharge circuit 230 to supply a given amount of energy E2 from the capacitor 231 to the spark plug 100 and cause a plasma discharge phenomenon. When the plasma is formed in the discharge cavity 60 in such a secondary discharge, the fouling of the spark plug 100 such as carbon etc. adhered to the interior of the discharge gap is burned away and cleaned by intense heat of the plasma without causing additional plug fouling.

Before the secondary ignition timing T2 (after the primary ignition timing T1), the capacitor 231 is charged by the high-voltage generator 233 in the same manner as mentioned above so that the energy E2 (hereinafter occasionally referred to as "secondary discharge activation energy") is stored in the capacitor 231.

There exists no air-fuel mixture serving as a carbon source in the discharge gap during the time period after the primary discharge and before the completion of the subsequent engine intake stroke. It is therefore possible to efficiently burn away the fouling of the spark plug 100, without additional plug fouling arising from the air-fuel mixture, and achieve easy cleaning of the spark plug 100 by generating the secondary discharge during the time period after the primary discharge and before the completion of the engine intake stroke. Because of the certain absence of air-fuel mixture in the discharge gap during the engine exhaust stroke, it is possible to burn away the fouling of the spark plug 100 more efficiently and facilitate the cleaning of the spark plug 100 by generating the secondary discharge during the engine exhaust stroke.

Herein, the transient plasma discharge phenomenon requires a great amount of activation energy so that the center and ground electrodes 20 and 30 of the spark plug 100 are more likely to be damaged by the plasma discharge phenomenon. If the secondary discharge is generated in the same manner as the primary discharge, such high-energy plasma discharge phenomenon takes place twice per cycle so that the degree of damage of the electrodes 20 and 30 is doubled. It is thus preferable that the secondary discharge activation energy E2 differs in amount from the primary discharge activation energy E1 in order to avoid causing the plasma discharge phenomenon by the same energy amount twice in one cycle and limit the degree of consumption of the plug electrodes 20 and 30. In this case, the primary discharge activation energy E1 may be adjusted according to various operating conditions such as the air-fuel ratio of the air-fuel mixture and temperature (coolant temperature) and the secondary discharge activation energy E2 may be set to a constant degree regardless of the primary discharge activation energy E1. It is more preferable that the amount of the secondary discharge activation energy E2 is smaller than that of the primary discharge activation energy E1 in order to avoid causing the plasma discharge phenomenon by the same high energy amount twice in one cycle and limit the degree of consumption of the plug electrodes 20 and 30 more assuredly. In the first embodiment, the output of the high-voltage generator 233 before the primary ignition timing T1 and the output of the high-voltage generator 233 before the secondary ignition timing T2 are set to 100% and 50%, respectively, so that the amount of the secondary discharge activation energy E2 is smaller than that of the primary discharge activation energy E1.

Although the secondary discharge activation energy E2 is set to a given constant degree in the first embodiment, the secondary discharge activation energy E2 may alternatively be adjusted in accordance with the degree of fouling of the spark plug 100. As the measure of the fouling degree of the spark plug 100, there can be used an insulation resistance between the electrodes 20 and 30 of the spark plug 100 in view of the fact that the insulation resistance between the plug electrodes 20 and 30 decreases with increase in the fouling degree of the spark plug 100. It is herein preferable to adjust the secondary discharge activation energy E2 in such a manner that the amount of the secondary discharge activation energy E2 increases with the fouling degree of the spark plug 100 (increases with decrease in the insulation resistance between the plug electrodes 20 and 30) and decreases with the fouling degree of the spark plug 100 (decreases with increase in the insulation resistance between the plug electrodes 20 and 30). When there is severe carbon fouling of the spark plug 100, the secondary discharge activation energy E2 can be made greater in amount than the primary discharge activation energy E1 so as to clean such severe plug fouling assuredly. When there is no carbon fouling of the spark plug 100, by contrast, the plasma discharge phenomenon may not be caused in the secondary discharge (i.e. the capacitor 231 may not be charged before the secondary ignition timing T2 so that the secondary discharge activation energy E2 becomes zero). This makes it possible to generate the secondary discharge efficiently and control the energy consumption of the spark plug 100 depending on the necessity for cleaning of the spark plug 100 for improvement in energy conservation.

A secondary embodiment of the present invention will be next explained below. The secondary embodiment is structurally the same as the first embodiment, except for the ignition control operation (ignition timing setting) of the ignition control device 200. It is noted that, in the second embodiment, the engine is of direct-injection type.

Figure 5:
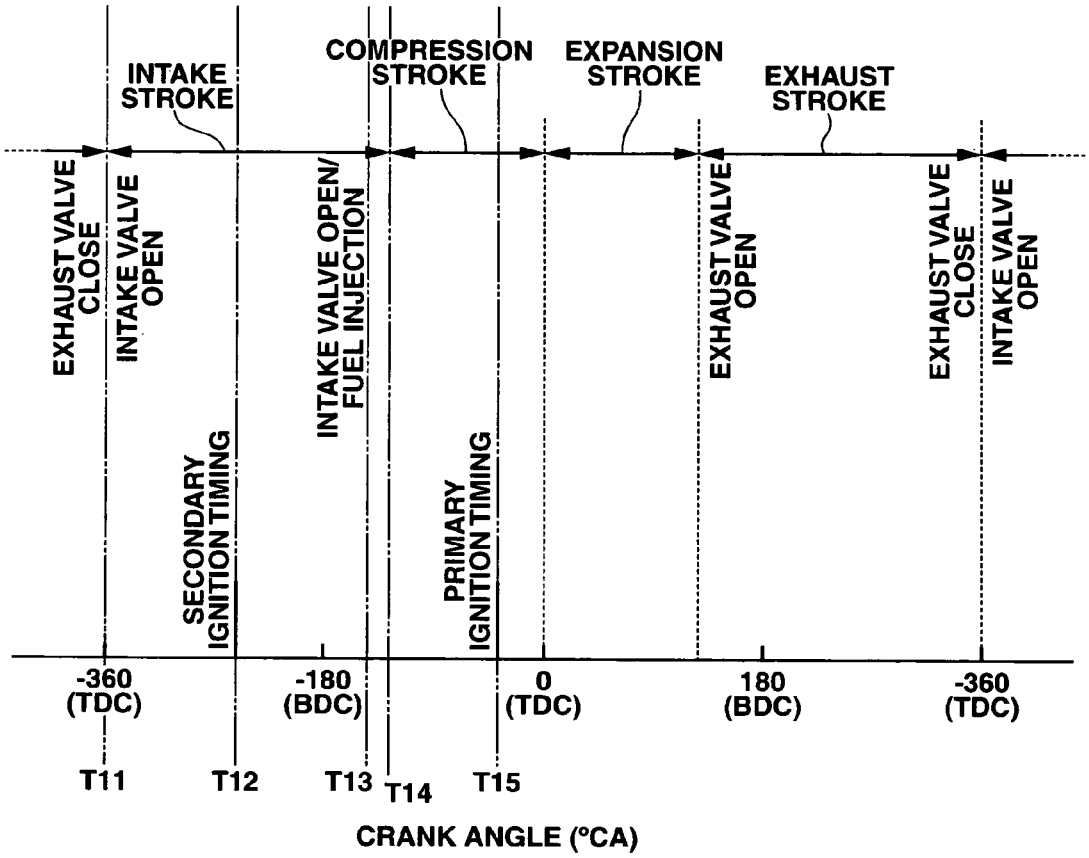
FIG. 5 is a time chart of ignition control operation of the ignition control device according to the second embodiment of the present invention.

As shown in FIG. 5, the control circuits 220 and 240 determine the timing of receipt of the periodical ignition signal from the ECU as a primary ignition timing T15. Further, the control circuits 220 and 240 periodically receipt an ignition advance map (in which the intake/exhaust valve opening/closing timings, fuel injection timing and ignition timing are correlated to the ignition advance information from the crank angle sensor to adjust each of the valve opening/closing timings, fuel injection timing and ignition timing according to engine operating conditions), specifies an intake valve opening timing T11 and a fuel injection timing T14 based on the latest ignition advance map and the ignition signal receipt interval, and then, determines any appropriate point during the time period between the intake valve opening timing T11 and the fuel injection timing T14 as a secondary ignition timing T12. By way of example, the midpoint between T11 and T14 is determined as the secondary ignition timing T12 so that the secondary ignition timing T12 is in the engine intake stroke in the second embodiment.

At the primary ignition timing T15, the control circuits 220 and 240 enables the spark discharge circuit 210 to apply a high voltage to the spark plug 100 and enables the plasma discharge circuit 230 to supply a given amount of energy E1 from the capacitor 231 to the spark plug 100, thereby causing the spark plug 100 to generate the primary discharge. The air-fuel mixture is ignited and burned by the plasma.

At the secondary ignition timing T12 (during the intake stroke after the expansion and exhaust strokes), the control circuits 220 and 240 enables the spark discharge circuit 210 to apply a high voltage to the spark plug 100 and enables the plasma discharge circuit 230 to supply a given amount of energy E2 to the spark plug 100, thereby causing the spark plug 100 to generate the secondary discharge. The carbon and any other fouling substance of the spark plug 100 is burned away by intense heat of the plasma.

The direct-injection engine is in the process of introducing the air into the combustion chamber during the time period between the intake valve opening timing T11 and the fuel injection timing T14 so that the surroundings of the spark plug 100 contains a relatively great amount of oxygen but does not contain fuel serving as a carbon source. It is therefore possible to efficiently burn away the fouling of the spark plug 100, without additional plug fouling arising from the air-fuel mixture, and achieve easy cleaning of the spark plug 100 by generating the secondary discharge during the time period between the intake valve opening timing T11 and the fuel injection timing T14.

The secondary discharge activation energy E2 may be adjusted in the same manner as mentioned above. When the secondary ignition timing T12 is set in the engine intake stroke, the surroundings of the spark plug 100 contains a great amount of oxygen at the secondary ignition timing T12. It is thus possible to burn away the fouling of the spark plug 100 efficiently and achieve sufficient cleaning of the spark plug 100 even if the secondary discharge activation energy E2 is reduced.

Depending on the design of the engine, there may a case where the fuel injection timing is set to a point T13 during the engine intake stroke. Even in such a case, the secondary ignition timing T12 can be set to any appropriate point during the time between the intake valve opening timing T11 and the fuel injection timing T13 for efficient cleaning of the spark plug 100.

It is needless to say that various modifications to the above embodiments are possible.

For example, the spark discharge circuit 210 may alternatively be of full-transistor type, point (contact) type or any other ignition circuit type.

The primary ignition timing T1, T15 is not necessarily set to the point during the engine compression stroke and may alternatively be set to any appropriate point during the engine expansion stroke.

Although the secondary ignition timing T2 is set to the point during the exhaust stroke in the first embodiment, the secondary ignition timing T2 may alternatively be set to an appropriate point after the initiation of the engine expansion stroke. Likewise, the secondary ignition timing T12 may alternatively be set to an appropriate point during the engine compression stroke or exhaust stoke although the secondary ignition timing T12 is set to the point during the engine intake stroke in the second embodiment. Namely, the secondary ignition timing T2, T12 is set to any time point after the primary discharge and before the completion of the subsequent engine exhaust stroke (in the case of direct-injection four-stroke engine, the completion of the subsequent engine intake stroke), as mentioned above, in order to enable efficient cleaning of the spark plug 100 without additional plug fouling caused by the air-fuel mixture. Further, the secondary ignition timing T2 is set to the midpoint of the ignition signal receipt interval in the first embodiment on the assumption that the midpoint of the ignition signal receipt interval is in the engine exhaust stroke, but is not necessarily set to the midpoint of the ignition signal receipt interval. The secondary ignition timing T2 may alternatively be set to a point a little in advance of the midpoint of the ignition signal receipt interval or a point after the lapse of a given time from the ignition signal receipt timing, or may alternatively be set by receiving an ignition advance map from the ECU and referring to the ignition advance map by the ignition signal receipt interval in the same way as in the second embodiment.

Although the ignition control device 200 is provided independently of and separately from the ECU so that the control circuits 220 and 240 determines the primary and secondary ignition timings T1 and T2, or T15 and T13, based on the ignition signal from the ECU in the above embodiments, the ECU can alternatively be configured to directly perform ignition timing control on the spark plug 100 by e.g. adjusting various operating parameters such as fuel injection amount and timing according to the input information from the crank angle sensor and combustion pressure sensor etc. and determining the primary and secondary ignition timings T1 and T2, or T15 and T13, based on these parameters. An intermediate circuit board may be arranged on the ignition signal output line between the ECU and the spark plug 100 so as to calculate the secondary ignition timing T2 or T13 from the timing of input of the ignition signal to the intermediate circuit board. The section of the ignition control device 200 associated with the ignition timing control (including the control circuits 220 and 240) may be formed with an ASIC (application-specific integrated circuit) configuration so as to determine the ignition timings T1 and T2, or T15 and T13, and control the operations of the discharge circuits 210 and 230 through program execution.

Although the output of the high-voltage generator 233 is changed to adjust the discharge activation energy E1, E2 stored in the capacitor 231 in the above embodiments, the plasma discharge circuit 230 may alternatively be equipped with two capacitors of different capacitances to supply the energy E1 from the capacitor of larger capacitance at the primary ignition timing T1, T15 and then supply the energy E2 from the capacitor of smaller capacitance at the secondary ignition timing T2, T13. The discharge activation energy E1, E2 stored in the capacitor 231 can also be adjusted by changing the time that the capacitor 231 is charged by the high-voltage generator 233.

Alternatively, the power source and circuit configuration of the control device 200 may be modified to allow a passage of electricity from the center electrode 20 to the ground electrode 30 e.g. by generating a positive-polarity voltage from the high-voltage generator 233 and by reversing the directions of the diodes 201 and 202. It is however desirable to design the control device 200 in such a manner as to allow the passage of electricity from the ground electrode 30 to the center electrode 20 as in the above embodiments, in view of the consumption of the center electrode 20, because the electrode tip 25 of the center electrode 20 is relatively small as compared to the ground electrode 30.

The entire contents of Japanese Patent Application No. 2005-337558 (filed on Nov. 22, 2005) and No. 2006-250583 (filed on Sep. 15, 2006) are herein incorporated by reference.

Although the present invention has been described with reference to the above-specific embodiments of the invention, the invention is not limited to the these exemplary embodiments. Various modification and variation of the embodiments described above will occur to those skilled in the art in light of the above teaching. The scope of the invention is defined with reference to the following claims.

What is claimed is:

1. A method for controlling a plasma-jet spark plug in a four-stroke internal combustion engine, the plasma-jet spark plug having a pair of electrodes defining therebetween a discharge gap and an electrical insulator surrounding at least part of the discharge gap to form a cavity in the discharge gap, the method comprising:

causing the spark plug to generate a primary discharge in the discharge gap during either a compression stroke or an expansion stroke of the engine in such a manner as to produce a plasma in the cavity; and causing the spark plug to generate a secondary discharge in the discharge gap during a time after the primary discharge and before the completion of a subsequent intake stroke of the engine.

2. The method according to claim 1, wherein the secondary discharge is generated during an exhaust stroke of the engine.

3. The method according to claim 1, wherein the engine is a direct-injection four-cycle internal combustion engine; and wherein the secondary discharge is generated during a time between an intake valve opening timing of the engine and a fuel injection timing of the engine.

4. The method according to claim 1, further comprising:

determining a primary ignition timing and a secondary ignition timing;

supplying primary discharge activation energy to the spark plug to generate the primary discharge at the primary ignition timing;

supplying secondary discharge activation energy to the spark plug to generate the secondary discharge at the secondary ignition timing; and adjusting the primary discharge activation energy and the secondary discharge activation energy in such manner that the amount of the primary discharge activation energy and the amount of the secondary discharge activation energy differ from each other.

5. The method according to claim 4, wherein the amount of the primary discharge activation energy is greater than the amount of the secondary discharge activation energy.

6. The method according to claim 4, further comprising:

determining a degree of fouling of the spark plug; and adjusting the amount of the secondary discharge activation energy in accordance with the degree of fouling of the spark plug.

7. A device for controlling a plasma-jet spark plug in a four-cycle internal combustion engine, the plasma-jet spark plug having a pair of electrodes defining therebetween a discharge gap and an electrical insulator surrounding at least part of the discharge gap to form a cavity in the discharge gap, the device being configured to: cause the spark plug to generate a primary discharge in the discharge gap during either a compression stroke or an expansion stroke of the engine in such a manner as to produce a plasma in the cavity; and cause the spark plug to generate a secondary discharge in the discharge gap during a time after the primary discharge and before the completion of a subsequent intake stroke of the engine.

8. The device according to claim 7, wherein the device is independent of and separate from an electric control unit of the engine.

9. The device according to claim 8, comprising:

spark discharge means for applying a voltage between the electrodes to cause a spark with an electrical breakdown in the discharge gap;

plasma discharge means for supplying energy to the discharge gap under said electrical breakdown to produce a plasma in the cavity;

control means for determining timings of said primary and secondary discharges and actuating said spark discharge circuit means and said plasma discharge means at the determined timings.

10. The device according to claim 9, wherein said control means controls said plasma discharge means to supply different amounts of energy to the discharge gap at the timings of said primary and secondary discharges.

11. A device for controlling a plasma-jet spark plug in a four-cycle internal combustion engine, the plasma-jet spark plug having a pair of electrodes defining therebetween a discharge gap and an electrical insulator surrounding at least part of the discharge gap to form a cavity in the discharge gap, the device comprising means for causing the spark plug to generate a primary discharge in the discharge gap during either a compression stroke or an expansion stroke of the engine in such a manner as to produce a plasma in the cavity; and means for causing the spark plug to generate a secondary discharge in the discharge gap during a time after the primary discharge and before the completion of a subsequent intake stroke of the engine.

12. The device according to claim 11, wherein the device is independent of and separate from an electric control unit of the engine.

13. The device according to claim 12, comprising:

spark discharge means for applying a voltage between the electrodes to cause a spark with an electrical breakdown in the discharge gap;

plasma discharge means for supplying energy to the discharge gap under said electrical breakdown to produce a plasma in the cavity;

control means for determining timings of said primary and secondary discharges and actuating said spark discharge circuit means and said plasma discharge means at the determined timings.

14. The device according to claim 13, wherein said control means controls said plasma discharge means to supply different amounts of energy to the discharge gap at the timings of said primary and secondary discharges.

* * * * *